US007880146B2

(12) United States Patent
Johnstone

(10) Patent No.: US 7,880,146 B2
(45) Date of Patent: Feb. 1, 2011

(54) TUNE-STABILIZED, NON-SCALING, FIXED-FIELD, ALTERNATING GRADIENT ACCELERATOR

(75) Inventor: Carol J. Johnstone, Warrenville, IL (US)

(73) Assignee: Universities Research Association, Inc., Washington, DC (US)

( * ) Notice: Subject to any disclaimer, the term of this patent is extended or adjusted under 35 U.S.C. 154(b) by 938 days.

(21) Appl. No.: 11/801,183

(22) Filed: May 8, 2007

(65) Prior Publication Data

US 2007/0273383 A1 Nov. 29, 2007

Related U.S. Application Data

(60) Provisional application No. 60/799,716, filed on May 10, 2006.

(51) Int. Cl.
*H01J 3/14* (2006.01)

(52) U.S. Cl. ..... 250/396 R; 250/492.22; 250/492.3; 315/507; 315/505

(58) Field of Classification Search ..... 315/5.41, 315/5.42, 500–507; 250/492.3, 492.1, 493.1, 250/396 R, 290, 291, 492.22
See application file for complete search history.

(56) References Cited

U.S. PATENT DOCUMENTS 5,557,178 A * 9/1996 Talman ..... 315/501
5,825,847 A * 10/1998 Ruth et al. ..... 378/119
6,777,893 B1 * 8/2004 Swenson ..... 315/505
7,432,516 B2 * 10/2008 Peggs et al. ..... 250/492.3
7,453,076 B2 * 11/2008 Welch et al. ..... 250/492.3
7,582,886 B2 * 9/2009 Trbojevic ..... 250/492.3

OTHER PUBLICATIONS

The Rebirth of the FFAG; Michael Craddock, CERN Courier AVF and FFAG Accelerators—Past, Present, and Future; Shane Koscielniak; TRIUMF, Feb. 2005.

* cited by examiner

*Primary Examiner*—Haissa Philogene
(74) *Attorney, Agent, or Firm*—Kermit D. Lopez; Luis M. Ortiz; Ortiz & Lopez, PLLC

(57) ABSTRACT

A FFAG is a particle accelerator having turning magnets with a linear field gradient for confinement and a large edge angle to compensate for acceleration. FODO cells contain focus magnets and defocus magnets that are specified by a number of parameters. A set of seven equations, called the FFAG equations relate the parameters to one another. A set of constraints, call the FFAG constraints, constrain the FFAG equations. Selecting a few parameters, such as injection momentum, extraction momentum, and drift distance reduces the number of unknown parameters to seven. Seven equations with seven unknowns can be solved to yield the values for all the parameters and to thereby fully specify a FFAG.

15 Claims, 6 Drawing Sheets

1) $k_{iF} l_{iF} = k_{iD} l_{iD} - \frac{\eta_D}{\rho_{iD}}$

2) $k_{iF} l_{iF} = 1/f = \frac{\sin \varphi/2}{(l_{eF} + l_{eD} + D)}$

3) $k_{iF} l_{iF} = k_{eF} l_{eF} + (\vartheta_{eF} + \eta_F)/\rho_{eF}$

4) $k_{iD} l_{iD} - \frac{\eta_D}{\rho_{iD}} = k_{eD} - (\vartheta_{eF} + \eta_D)/\rho_{eD}$ 5) $\vartheta_{iD} = \vartheta_{eF} + \vartheta_{eD}$ 6) $l_{eF} = l_{iF} + \Delta x_F (\vartheta_{eF} + \eta_F)$ 7) $l_{eD} = l_{iD} + \Delta x_D (\vartheta_{iD} + \eta_D)$

*Fig. 6*

$$1/\rho_{iD} = 0.3B_{iD}/p_i$$

$$1/\rho_{eF} = 0.3B_{eF}/p_e$$

$$1/\rho_{eD} = 0.3B_{eD}/p_e$$

$$\vartheta_{iD} = 0.3B_{iD}l_{iD}/p_i$$

$$\vartheta_{eF} = 0.3B_{eF}l_{eF}/p_e$$

$$\vartheta_{eD} = 0.3(B_{eD} - B_{eF})l_{eD}/p_e$$

$$k_{iF} = 0.3(B_{iF} - B_{eF})/p_i\Delta x_F$$

$$k_{iD} = 0.3(B_{iD} - B_{eD})/p_i\Delta x_D$$

$$k_{eF} = \frac{p_i}{p_e}k_{iF}$$

$$k_{eD} = \frac{p_i}{p_e}k_{iD}$$

*Fig. 7*

TUNE-STABILIZED, NON-SCALING, FIXED-FIELD, ALTERNATING GRADIENT ACCELERATOR

CROSS REFERENCE TO RELATED APPLICATIONS

This patent application claims the priority and benefit of U.S. Provisional Patent Application No. 60/799,716 filed on May 10, 2006 entitled "TUNE-STABILIZED, NON-SCALING, FIXED-FIELD, ALTERNATING GRADIENT ACCELERATOR" and which is incorporated herein by reference in its entirety.

STATEMENT OF GOVERNMENT INTEREST

This invention was made with government support under Contract No. DE-AC02-76CH03000 awarded by the U.S. Department of Energy. The government has certain rights in the invention.

TECHNICAL FIELD

Embodiments relate to the fields of electromagnetic fields, magnets, and particle accelerators. Embodiments also relate to the field of constrained systems of equations, and computational methods for solving constrained systems of equations.

BACKGROUND

Particle accelerators have been researched and produced since the discovery of electric fields and electrical potential. Initially, linear accelerators were developed followed by a variety of ring shaped accelerators which are now a common and often the most economical choice in many technical applications In general, charged particles are sent through an injection port into a ring shaped accelerator that then accelerates them. The accelerated particles can then be obtained as they exit out of an extraction port.

There are many types of ring shaped accelerators and all of them require careful control over electric fields and magnetic fields. The electric fields accelerate the particles. The magnetic fields bend particle trajectories so that the particles remain within the accelerator. The required careful control is accomplished with complex magnetic field configurations in conjunction with sophisticated control systems. In ring accelerators such systems are almost always required to dynamically adjust the fields. Limits, therefore, exist, particularly in ring accelerators, regarding the rate at which parameters can be dynamically adjusted. This rate of parameter change affects the acceleration cycle time, total current (duty cycle), and other technical requirements such as variations in energy that can be dynamically delivered. Systems and methods for accelerating particles with ring accelerators are needed which improve performance and output such as enhancing the beam current, increasing the dynamical range or variability in beam parameters, or simplifying or reducing the cost of the control system, magnets, power supplies, and other ring components.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

Fundamental design methods providing for accelerating charged particles with non-scaling fixed-field, alternating-gradient accelerators are needed in particular new approaches which stabilize the tune dynamically.

It is therefore an aspect of the embodiments that a focus magnet which focuses or confines the beam in the horizontal plane using fixed, not dynamically adjusted fields, can be specified by parameters which include an injection field strength, an extraction field strength, the length of the magnet at injection, the length of the magnet at extraction, and the horizontal orbit separation between the two.

It is also an aspect of the embodiments that the so-termed, defocus magnet, which defocuses beam in the horizontal plane, but confines or focuses vertically, is also specified by parameters that include an injection field strength, an extraction field strength, the length of the magnet required at injection, the magnetic length at extraction, and the orbit separation in the horizontal plane between the two.

It is a further aspect of the embodiments that the focus magnet and the defocus magnet are positioned with a separation specified by a drift distance and are part of a system having conventional accelerator system parameters such as a phase advance, an injection momentum, and an extraction momentum.

It is a yet further aspect of the embodiments that the parameters defining horizontally-focusing magnets, defocusing magnets, phase advance, and a drift distance can be related by seven equations. The seven equations describe stable beam motion in a fixed, linear-field magnetic FODO cell which is constrained in phase advance, or tune, at injection and extraction. This FODO cell comprises the basic building block of a non-scaling, linear-field FFAG (NLFFAG) with likewise constrained tune. As such, the seven equations are called the NLFFAG equations. A solution to the NLFFAG equations can be obtained by applying both technical constraints and magnetic optics constraints to the NLFFAG equations. The technical constraints and the magnetic optics constraints are called the NLFFAG constraints.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the background of the invention, brief summary of the invention, and detailed description of the invention, serve to explain the principles of the present invention.

FIG. 6 illustrates the NLFFAG equations in accordance with aspects of the embodiments; and FIG. 7 illustrates the NLFFAG constraints in accordance with aspects of the embodiments.

DETAILED DESCRIPTION

The particular values and configurations discussed in these non-limiting examples can be varied and are cited merely to illustrate at least one embodiment and are not intended to limit the scope thereof. In general, the figures are not to scale.

A FFAG is a particle accelerator having turning magnets with a fixed field gradient designed for beam confinement across a specified energy range and within a defined magnet aperture. FODO cells contain focus magnets and defocus magnets that are specified by a number of parameters such as focusing strength which is nominally expressed in terms of length and the magnetic field value or its gradient. Here, FODO cells are used as the basic optics unit of the FFAG. A set of seven equations have been developed which, relate the simple, linear FODO cell optical and geometrical parameters to one another as required to build a non-scaling FFAG that is constrained in tune. These seven equations impose the constraint of both fixed, linear fields (either constant or linear gradient fields) and fixed tune. In the approach used to derive these equations, phase advance or tune is constrained at the injection and extraction momentum. Magnetic optical constraints in the presence of fixed and linear field gradients further reduce the equations (FIG. 7). Then, selecting a few parameters, such as injection momentum, extraction momentum, and drift distance reduces the number of unknown parameters to seven. Seven equations with seven unknowns can be solved to yield the values for all the parameters and to thereby completely specify the magnetic and optical parameters of a non-scaling, linear-field FFAG with stable tune at both injection and extraction.

Figure 1:
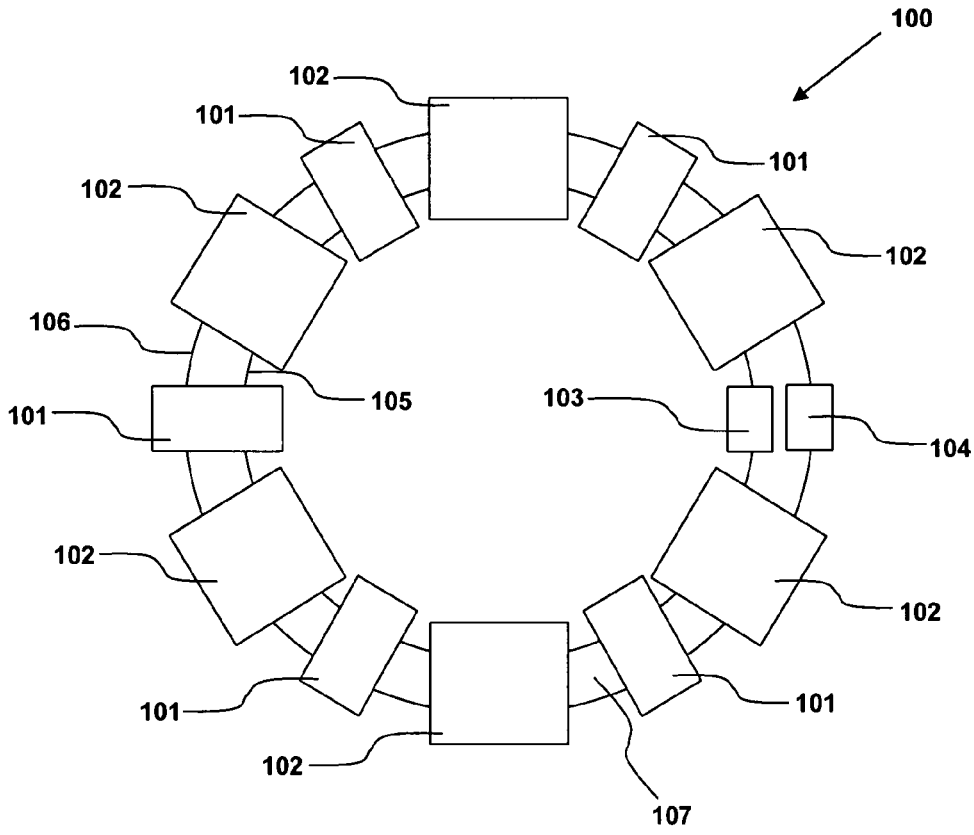
FIG. 1 illustrates a NLFFAG accelerator in accordance with aspects of the embodiments.

FIG. 1 illustrates a NLFFAG accelerator 100 in accordance with aspects of the embodiments. Injection into a ring accelerator generally occurs through components placed in the drifts (septum magnet and pulsed kicker device). If the consecutive orbit to orbit separation is sufficient, injection of beam onto the injection orbit can potentially occur using a single septum magnet installed in the drift between a focus and defocus magnet. A septum magnet has a knife edge with field on one side and 0-field on the ring side so as not to interfere with circulating beam. Extraction will be the reverse of injection—either a pulsed kicker magnet will fire or eventually the orbit separation will be large enough that it will cross into a field region of a septum magnet and bend out of the ring. Other potential ways of extracting are to use half-integer resonant extraction, for example, but all approaches use a septum-like magnet to pull beam in or out of the ring. An injection port 103, therefore, can accept charge particles that can then exit through an extraction port 104. The particles travel around the accelerator through a clear path 107. The inside edge 105 of the clear path 107 is a closed path and is smaller than the particle's injection orbit. The outside edge 106 of the clear path is a closed path and is larger than the particle's extraction orbit. Accelerator modules 101 and FODO cells 102 have apertures which wrap around inside edge 105 and outside edge 106 closed paths. A toroidal shaped vacuum vessel can contain the clear path 107.

Upon injection, the particles have an injection momentum, $p_i$, and are accelerated by the accelerator modules 101 until they reach an extraction momentum, $p_e$. The FODO cells bend the particle paths so that the particles orbit through the clear path.

Figure 2:
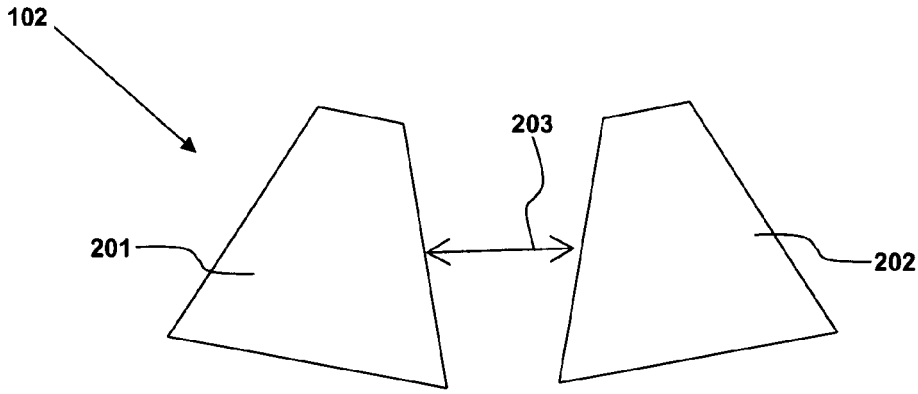
FIG. 2 illustrates a FODO cell in accordance with aspects of the embodiments.

FIG. 2 illustrates a FODO cell 102 in accordance with aspects of the embodiments. A FODO cell contains a focus magnet 201 and a defocus magnet 202. The magnets are separated by a drift distance, D.

Figure 3:
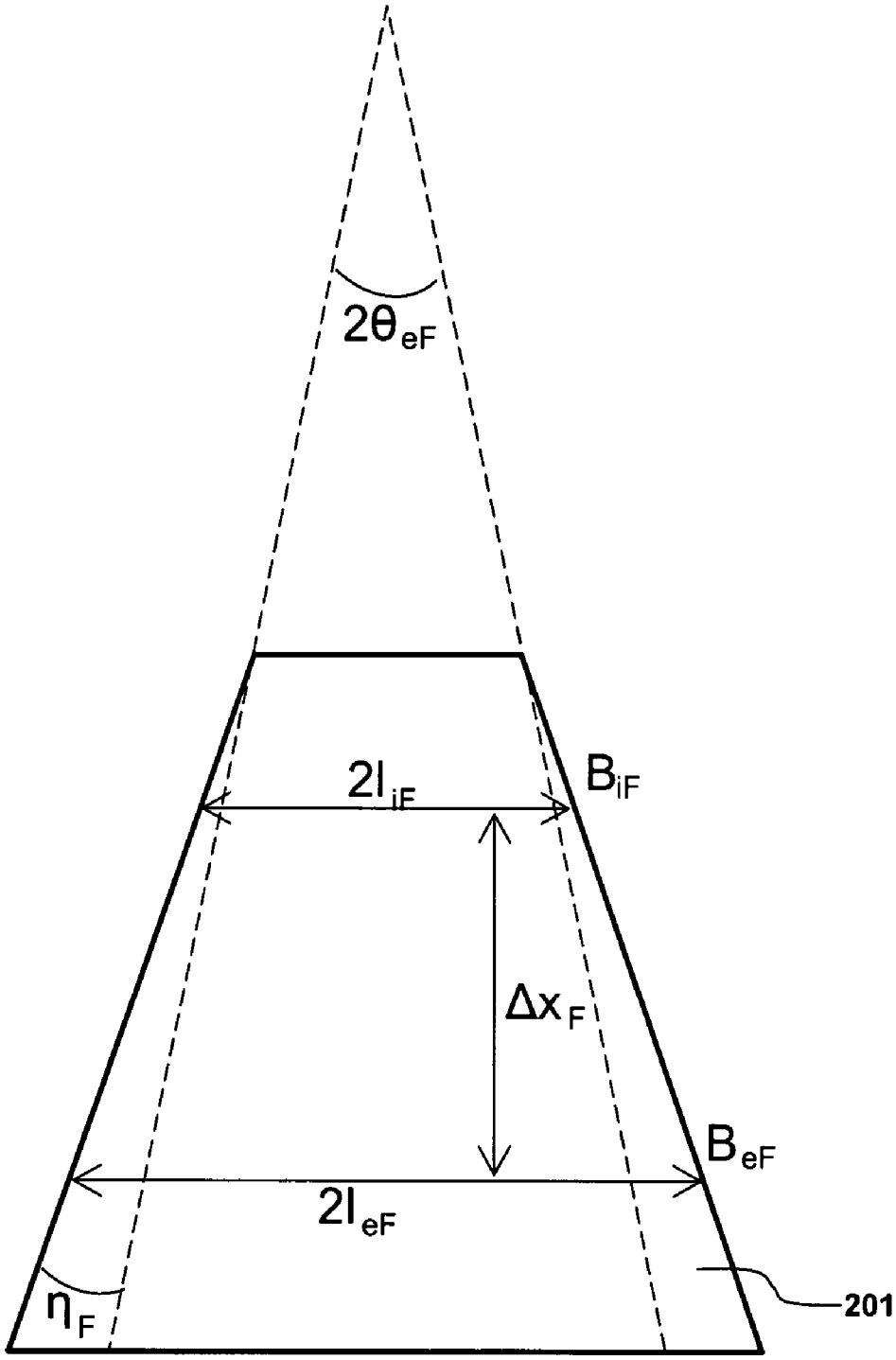
FIG. 3 illustrates a focus magnet in accordance with aspects of the embodiments.

FIG. 3 illustrates a focus magnet 201 in accordance with aspects of the embodiments. The total length of the focus magnet at the extraction orbit, near the base, is twice the defined length parameter, $l_{eF}$. The total length at the injection orbit, near the top, is twice the defined length parameter, $l_{iF}$. The injection orbit and extraction orbit are separated in the focus magnet by the distance, $\Delta x_F$. On the injection orbit, the focus magnet 201 has an injection field strength of $B_{iF}$. On the extraction orbit, the focus magnet 201 has an extraction field strength of $B_{eF}$. These lengths, separations, and fields are sufficient to specify the focus magnet 201. Two angles, $\vartheta_{eF}$ and, $\eta_F$ must also be used to describe the focus magnets 201 in order to obtain the optical conditions derived in the seven optics equations describing the NLFFAG FODO cell. Those practiced in the art of particle accelerators are familiar with designing such turning magnets.

Figure 4:
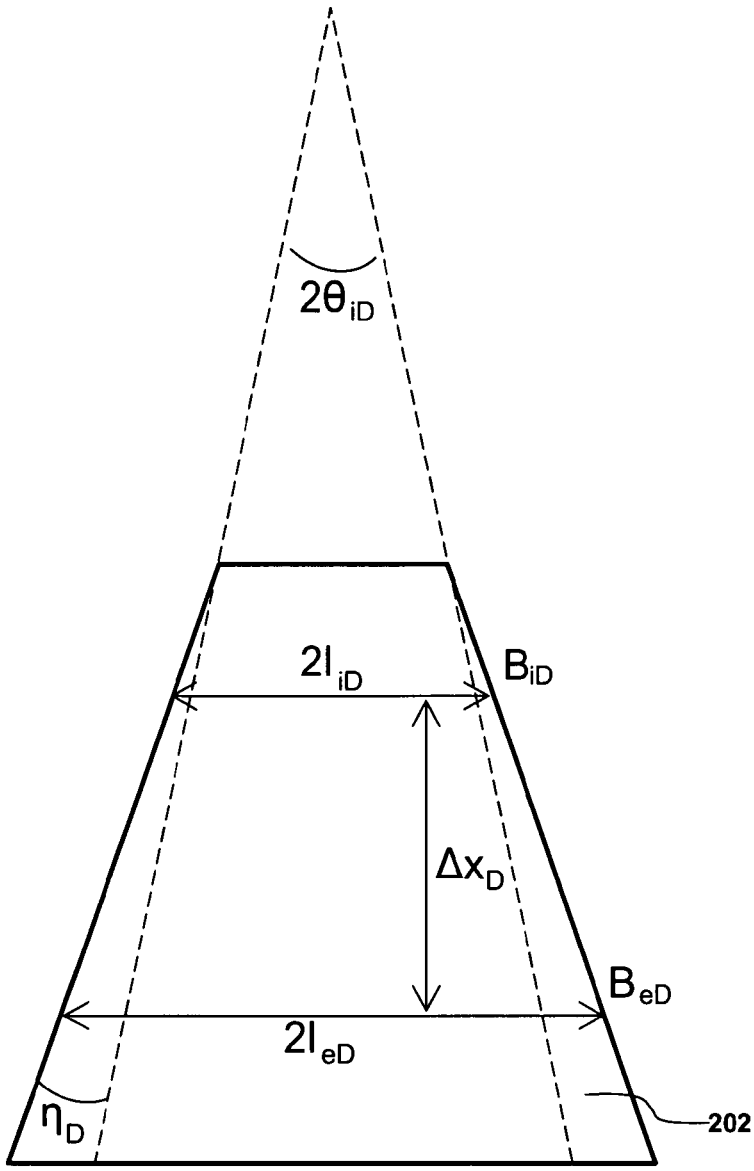
FIG. 4 illustrates a defocus magnet in accordance with aspects of the embodiments.

FIG. 4 illustrates a defocus magnet 202 in accordance with aspects of the embodiments. The length of the defocus magnet at the extraction orbit, near the base, is twice the defined length parameter, $l_{eD}$. The length at the injection orbit, near the top, is twice the defined length parameter, $l_{iD}$. The injection orbit and the extraction orbit in the defocus magnet are separated by the distance, $\Delta x_D$. On the injection orbit, the defocus magnet 202 has an injection field strength of $B_{iD}$. On the extraction orbit, the defocus magnet 202 has an extraction field strength of $B_{eD}$. These lengths, separations, and fields are sufficient to specify the defocus magnet 202. Two angles, $\vartheta_{eD}$ and $\eta_D$ must also be used to describe the defocus magnets 202 in order to obtain the optical conditions derived in the seven optics equations describing the NLFFAG FODO cell.

Figure 5:
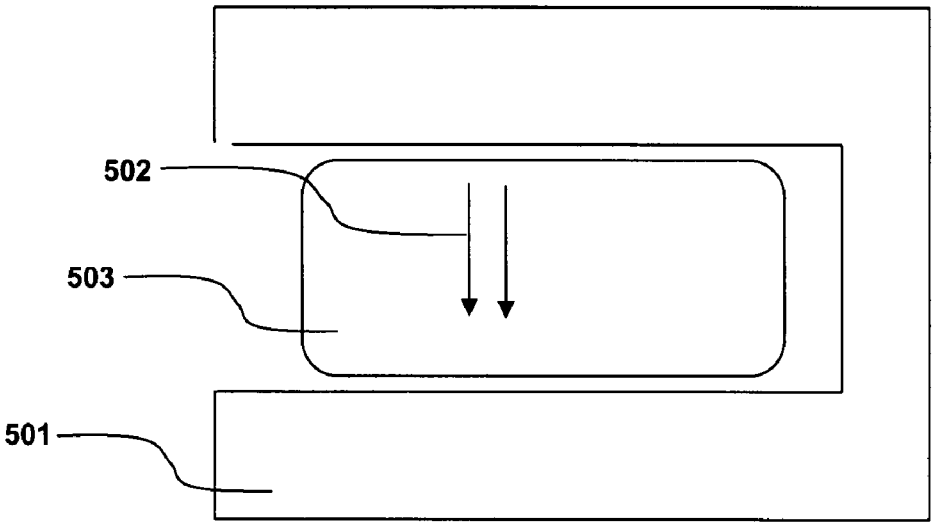
FIG. 5 illustrates a magnet cross section view in accordance with aspects of the embodiments.

FIG. 5 illustrates a magnet side view in accordance with aspects of the embodiments. The magnet 501 can have magnetic field lines 502 running predominantly perpendicular to the particle orbits. A vacuum vessel 503 can contain the clear path.

FIG. 6 illustrates magnetic optical equations in their low-order form obtained by applying only linear fields and using the thin lens approximations. The equations describe both horizontal and vertical focusing with magnetic fields in terms of conventional accelerator parameters and stable orbit geometry in a fixed-field FODO cell which has been constrained in phase advance, $\phi$. The constraint of fixed phase advance has been invoked at injection and extraction for both planes. This FODO cell further comprises the basic, repetitive unit of a non-scaling FFAG which is also constrained in tune or phase advance in accordance with aspects of the embodiments. The seven equations of FIG. 6 are called the NLFFAG equations. The NLFFAG equations consist of seven equations having 20 variables.

D is the drift distance.

f is the focal length which is related to phase advance, $\phi$, and half cell length.

$k_{eD}$ is strength of the linear field (quadrupole) gradient at extraction in $m^{-2}$, for the defocus magnet. FIG. 7 gives exact relationship of the k values to absolute field gradient, B/aperture, and momentum, p. Note since the linear field gradient is constant, the focusing strength scales inversely with momentum.

$k_{eF}$ is strength of the linear field gradient at extraction in the focus magnet.

$k_{iF}$ is strength of the linear field gradient at injection in the focus magnet.

$k_{iD}$ is the strength of the linear field gradient at injection in the defocus quad.

$l_{eD}$ is half the total defocus magnet extraction length.

$l_{eF}$ is half the total focus magnet extraction length.

$l_{iF}$ is half the total focus magnet injection length $l_{iD}$ is half the total defocus magnet injection length $\eta_D$ is the defocus magnet edge angle adjustment: an edge angle relative to the sector edge angle defined below. In beam optics beam enters normal to the face of a sector magnet and its total bend through the magnet is equal to the sector angle. This additional edge angle adds or subtracts from the sector angle to form the physical edge angle of the magnet, but also represents the non-normal entrance of the beam, hence it is a separate variable from the sector angle in the optics equations.

$\eta_F$ is the focus magnet edge angle adjustment $\rho_{iD}$ is the bend radius in the defocus magnet at the injection momentum.

$\rho_{eD}$ is the bend radius in the defocus magnet at extraction momentum.

$\rho_{eF}$ is the bend radius in the focus magnet at the extraction momentum.

$\vartheta_{eD}$ is the bend angle of beam at extraction through the defocus magnet.

$\vartheta_{eF}$ is the focus magnet sector angle which is a physical edge angle and also represents the total bend of extraction beam through the focus magnet.

$\vartheta_{iD}$ is the defocus magnet sector angle which is a physical edge angle and again represents the total bend angle of injection beam through the defocus magnet.

$\Delta x_F$ is the focus magnet orbit separation between injection and extraction.

$\Delta x_D$ is the defocus magnet focus separation between injection and extraction.

FIG. 7 illustrates the NLFFAG constraints in accordance with aspects of the embodiments. The NLFFAG constraints are general relationships in magnetic field dynamics and optics with two of the constraints unique to the fixed, linear-field FODO unit comprising the NLFFAG. The NLFFAG constraints express the optical variables in the NLFFAG equations in terms of technical specifications such as magnetic fields, momentum, and orbit separation or aperture, but also include, in the last two equations, the fixed-field relationships of the linear-field, non-scaling FFAG. Most importantly, if technical choices are made in the field strength, injection and extraction momentum, then along with the fixed-field scaling relationships, the variables in the NLFFAG equations are eventually reduced to 7. In the NLFFAG equations these are the following parameter definitions.

$B_{eD}$ is the magnetic field in the defocus magnet at the extraction orbit.

$B_{eF}$ is the magnetic field strength in the focus magnet at the extraction orbit.

$B_{iD}$ is the magnetic field strength in the defocus magnet at the injection orbit.

$B_{iF}$ is the magnetic field strength in the focus magnet at the injection orbit.

$k_{iF}$ is the linear-field gradient strength in the focus magnet at injection.

$p_e$ is the extraction momentum.

$p_i$ is the injection momentum.

$\rho_{eD}$ is the bend radius in the defocus magnet at extraction.

$\rho_{eF}$ is the bend radius in the focus magnet at extraction.

$\rho_{iD}$ is the bend radius in the defocus magnet at injection.

$\vartheta_{iD}$ is the sector angle and the angle through which injection beam bends through in the defocus magnet.

Setting some of the variables to desired values reduces the number of unknown variables to seven. As such, the seven equations can be solved to yield values for all of the variables. Those practiced in the art of mathematics are familiar with solving systems of equations. Note that focal length, f, is given in terms of the combined (half) lengths of the focus and defocus magnets at extraction plus the drift so it is not fully specified and there are only 7 true values for parameters below.

As an example, set $B_{eF}$ to 1.5 Tesla.

$B_{iD}$ to 1.5 Tesla.

$B_{iF}$ to 0 Tesla.

$p_e$ to 0.954 MeV/c.

$p_i$ to 0.2385 MeV/c.

D to 0.5 meters.

f to $1.4\times L_{1/2}$, the half cell length, ($\phi=90°$, $L_{1/2}=(l_{ef}+l_{ed}+D)$.

$\Delta x_F$ to 1 meter.

Then $B_{eD}$ is −0.9 Tesla.

$l_{eD}$ is 0.272 meters.

$l_{eF}$ is 0.652 meters.

$l_{iF}$ is 0.26 meters.

$l_{iD}$ is 0.117 meters.

$\Delta x_D$ is 0.55 meters.

As such, the focus and defocus magnets are sufficiently specified and can be produced and used within the FODO cells of a FFAG.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system comprising:

a focus magnet specified by focus parameters comprising $B_{iF}$, $B_{eF}$, $l_{iF}$, $l_{eF}$, and $\Delta x_F$; and a defocus magnet specified by defocus parameters comprising $B_{iD}$, $B_{eD}$, $l_{iD}$, $l_{eD}$, and $\Delta x_D$; wherein the focus magnet and the defocus magnet are positioned with a separation specified by D; wherein the system is specified by system parameters comprising $p_e$, $p_i$, and f wherein $B_{iF}$ is the magnetic field strength in the focus magnet at the injection orbit, $B_{eF}$ is the magnetic field strength in the focus magnet at the extraction orbit, $l_{iF}$ is half the total focus magnet injection length, $l_{eF}$ is half the total focus magnet extraction length, $\Delta x_F$ is the focus magnet orbit separation between injection and extraction, $B_{iD}$ is the magnetic field strength in the defocus magnet at the injection orbit, $B_{eD}$ is the magnetic field in the defocus magnet at the extraction orbit, $l_{iD}$ is half the total defocus magnet injection length, $l_{eD}$ is half the total defocus magnet extraction length, $\Delta x_D$ is the defocus magnet focus separation between injection and extraction, $p_e$ is the extraction momentum, $p_i$ is the injection momentum, and f is the focal length; and wherein $B_{iF}$, $B_{eF}$, $l_{iF}$, $l_{eF}$, $\Delta x_F$, $B_{iD}$, $B_{eD}$, $l_{iD}$, $l_{eD}$, $\Delta x_D$, D, $p_e$, $p_i$, and f are related by non-scaling, linear-field FFAG (NLFFAG) equations and constrained by NLFFAG constraints.

2. The system of claim 1 further comprising a clear path passing through the focus magnet and the defocus magnet.

3. A system comprising:

a plurality of FODO cells comprising a focus magnet and a defocus magnet positioned with a separation specified by D;

wherein each focus magnet is specified by focus parameters comprising $B_{iF}$, $B_{eF}$, $l_{iF}$, $l_{eF}$, and $\Delta x_F$; and wherein each defocus magnet is specified by defocus parameters comprising $B_{iD}$, $B_{eD}$, $l_{iD}$, $l_{eD}$, and $\Delta x_D$;

wherein the system is specified by system parameters comprising $p_e$, $p_i$, and f wherein $B_{iF}$ is the magnetic field strength in the focus magnet at the injection orbit, $B_{eF}$ is the magnetic field strength in the focus magnet at the extraction orbit, $l_{iF}$ is half the total focus magnet injection length, $l_{eF}$ is half the total focus magnet extraction length, $\Delta x_F$ is the focus magnet orbit separation between injection and extraction, $B_{iD}$ is the magnetic field strength in the defocus magnet at the injection orbit, $B_{eD}$ is the magnetic field in the defocus magnet at the extraction orbit, $l_{iD}$ is half the total defocus magnet injection length, $l_{eD}$ is half the total defocus magnet extraction length, $\Delta x_D$ is the defocus magnet focus separation between injection and extraction, $p_e$ is the extraction momentum, $p_i$ is the injection momentum, and f is the focal length; and wherein $B_{iF}$, $B_{eF}$, $l_{iF}$, $l_{eF}$, $\Delta x_F$, $B_{iD}$, $B_{eD}$, $l_{iD}$, $l_{eD}$, $\Delta x_D$, D, $p_e$, $p_i$, and f are related by non-scaling, linear-field FFAG (NLFFAG) equations and constrained by NLFFAG constraints.

4. The system of claim 3 wherein a clear path passes through each FODO cell.

5. The system of claim 4 further comprising a vacuum vessel enclosing the clear path.

6. The system of claim 4 further comprising a particle injection port through which particles are injected into the clear path.

7. The system of claim 4 further comprising a particle extraction port through which particles are extracted from the clear path.

8. A system comprising:

at least one acceleration module;

a plurality of FODO cells comprising a focus magnet and a defocus magnet positioned with a separation specified by D;

where the acceleration modules and the FODO cells are positioned along a closed path;

wherein each focus magnet is specified by focus parameters comprising $B_{iF}$, $B_{eF}$, $l_{iF}$, $l_{eF}$, and $\Delta x_F$; and wherein each defocus magnet is specified by defocus parameters comprising $B_{iD}$, $B_{eD}$, $l_{iD}$, $l_{eD}$, and $\Delta x_D$;

wherein the system is specified by system parameters comprising $p_e$, $p_i$, and f wherein $B_{iF}$ is the magnetic field strength in the focus magnet at the injection orbit, $B_{eF}$ is the magnetic field strength in the focus magnet at the extraction orbit, $l_{iF}$ is half the total focus magnet injection length, $l_{eF}$ is half the total focus magnet extraction length, $\Delta x_F$ is the focus magnet orbit separation between injection and extraction, $B_{iD}$ is the magnetic field strength in the defocus magnet at the injection orbit, $B_{eD}$ is the magnetic field in the defocus magnet at the extraction orbit, $l_{iD}$ is half the total defocus magnet injection length, $l_{eD}$ is half the total defocus magnet extraction length, $\Delta x_D$ is the defocus magnet focus separation between injection and extraction, $p_e$ is the extraction momentum, $p_i$ is the injection momentum, and f is the focal length; and wherein $B_{iF}$, $B_{eF}$, $l_{iF}$, $l_{eF}$, $\Delta x_F$, $B_{iD}$, $B_{eD}$, $l_{iD}$, $l_{eD}$, $\Delta x_D$, D, $p_e$, $p_i$, and f are related by non-scaling, linear-field FFAG (NLFFAG) equations and constrained by NLFFAG constraints.

9. The system of claim 8 wherein a clear path passes through each FODO cell and through each acceleration module.

10. The system of claim 9 further comprising a vacuum vessel enclosing the clear path.

11. The system of claim 9 further comprising a particle injection port through which particles are injected into the clear path.

12. The system of claim 9 further comprising a particle extraction port through which particles are extracted from the clear path.

13. The system of claim 8 further comprising:

comprising a vacuum vessel enclosing the clear path; and a particle extraction port through which particles are extracted from the clear path.

14. The system of claim 8 further comprising:

comprising a vacuum vessel enclosing the clear path; and a particle injection port through which particles are injected into the clear path.

15. The system of claim 8 further comprising:

comprising a vacuum vessel enclosing the clear path;

a particle injection port through which a plurality of particles are injected into the clear path; and particle extraction port through which the particles are extracted from the clear path;

wherein the acceleration modules accelerate the particles such that the particles have greater momentum when extracted than when injected.

* * * * *